US006091798A

United States Patent [19]

Nygren et al.

[11] Patent Number: 6,091,798

[45] Date of Patent: Jul. 18, 2000

[54] COMPOUND REFRACTIVE X-RAY LENS

[75] Inventors: David R. Nygren, Berkeley; Robert Cahn, Walnut Creek, both of Calif.; Bjorn Cederstrom, Traellborg, Sweden; Mats Danielsson, Stocksund, Sweden; Jonas Vestlund, Stockholm, Sweden

[73] Assignee: The Regents of the University of California, Oakland, Calif.

[21] Appl. No.: 09/103,658

[22] Filed: Jun. 23, 1998

Related U.S. Application Data

[60] Provisional application No. 60/059,752, Sep. 23, 1997.

[51] Int. Cl.[7] ..... G21K 1/00

[52] U.S. Cl. ..... 378/84; 378/85; 378/145

[58] Field of Search ..... 378/145, 84, 85; 359/455

[56] References Cited

U.S. PATENT DOCUMENTS 5,594,773 1/1997 Tomie ..... 378/34

*Primary Examiner*—David P. Porta

*Attorney, Agent, or Firm*—Paul R. Martin; Henry Satorio; David J. Aston

[57] ABSTRACT

An apparatus and method for focusing X-rays. In one embodiment, his invention is a commercial-grade compound refractive X-ray lens. The commercial-grade compound refractive X-ray lens includes a volume of low-Z material. The volume of low-Z material has a first surface which is adapted to receive X-rays of commercially-applicable power emitted from a commercial-grade X-ray source. The volume of low-Z material also has a second surface from which emerge the X-rays of commercially-applicable power which were received at the first surface. Additionally, the commercial-grade compound refractive X-ray lens includes a plurality of openings which are disposed between the first surface and the second surface. The plurality of openings are oriented such that the X-rays of commercially-applicable power which are received at the first surface, pass through the volume of low-Z material and through the plurality openings. In so doing, the X-rays which emerge from the second surface are refracted to a focal point.

24 Claims, 4 Drawing Sheets

COMPOUND REFRACTIVE X-RAY LENS

RELATED APPLICATIONS

This application claims priority of provisional application Ser. No. 60/059,752 filed Sep. 23, 1997.

GOVERNMENT RIGHTS

The research carried out in the subject application was supported in part by grants from the Department of Energy (Contract No. DE-ACO3-76SF00098). The government may have rights in any patent issuing on this application.

TECHNICAL FIELD

The present invention relates to the field X-rays and, more specifically, to X-ray focusing using a compound refractive lens.

BACKGROUND OF THE INVENTION

Recent experiments have demonstrated the possibility of substantial X-ray focusing. An example of such an experiment is described the journal "Nature" Vol. 384, dated Nov. 7, 1996 in an article entitled "A Compound Refractive Lens for Focusing High-Energy X-rays" by Snigirev, et al. The article recites the use of an X-ray lens for focusing high-energy X-rays generated from complex and experimental radiation sources, such as the European Synchrotron Radiation Facility (ESRF). Further, such a complex and experimental radiation source generates a parallel monochromatic X-ray beam which is substantially different from the output produced by commercial-grade X-ray sources. Although such experiments demonstrate the focusing of high-energy X-rays, these experimental methods and techniques are not particularly relevant to or useful in commercial-grade applications.

In addition to not being particularly well suited to commercial-grade applications, X-ray lenses used in high-energy X-ray focusing experiments are not readily manufacturable. For example, the X-ray lens used in the above-described experiment by Snigirev, et al. is formed of a 19 millimeter block of aluminum having approximately 30 circular holes drilled therein. While such manufacturing techniques are adequate for small-scale high-energy X-ray experiments, such manufacturing approaches are not adequate for large-scale higher-volume manufacturing operations.

As yet another example of the shortcomings associated with prior art high-energy X-ray focusing techniques, such prior art high-energy X-ray focusing attempts are limited to generating a single energy peak distribution. Hence, such experimental methods are not well suited to applications requiring more than one X-ray energy peak.

Thus, a need exists for an X-ray lens which is well suited for commercial applications. A further need exists for a method readily to form a compound refractive X-ray lens. Still another need exists for a compound refractive X-ray lens which is able to generate a dual energy distribution from an X-ray source.

SUMMARY OF THE INVENTION

The present invention provides an X-ray lens which is well suited for commercial applications. The present invention further provides a method readily to form a compound refractive X-ray lens. The present invention also provides a compound refractive X-ray lens which is able to generate a dual energy distribution from an X-ray source. The present invention achieves the above accomplishments with novel X-ray focusing apparati, novel X-ray lens formation methods, and novel methods for focusing X-rays.

More specifically, in one embodiment, this invention is a commercial-grade compound refractive X-ray lens. The commercial-grade compound refractive X-ray lens includes a volume of low-Z material. The volume of low-Z material has a first surface that receives X-rays of commercially-applicable power emitted from a commercial-grade X-ray source. The volume of low-Z material also has an opposite, second surface from which the X-rays emerge. Additionally, the commercial-grade compound refractive X-ray lens includes a plurality of openings which are disposed between the first surface and the second surface. The plurality of openings are oriented such that the X-rays of commercially-applicable power which are received at the first surface, pass through the volume of low-Z material and through the plurality openings. In so doing, the X-rays of a single energy that emerge are refracted to a single focal point. If the x-ray source emits x-rays of variable energy, the spectrum of x-rays received at a single focal point will be enhanced near a unique energy.

In another embodiment, the present invention recites a split-compound refractive X-ray lens. In this embodiment, the split-compound refractive X-ray lens is comprised of a first half and a second half. Each of the first half and the second half is comprised of a volume of low-Z material. The volumes of low-Z material have a top surface that receives X-rays from an X-ray source and a bottom from which the x-rays emerge. Both the first half and the second half also include a side surface extending between their respective top surface and bottom surface. Additionally, each of the first half and the second half has a plurality of indentations formed in their side surface. The plurality of indentations are disposed between their respective top surface and bottom surface. The respective plurality of indentations are oriented such that the X-rays, which are received at the top surface, pass through the volume of low-Z material and the plurality of indentations, are emitted from the bottom surface, and are refracted to the same focal point, whose location depends on the energy of the incident x-rays.

In still another embodiment, the present invention recites a method for providing a dual energy distribution from an X-ray source using a split-compound refractive X-ray lens. In such an embodiment, the present invention disposes two halves of a split-compound refractive X-ray lens proximate to an X-ray source. The two halves have their indentations formed so that X-rays of one energy are focused by the first half at a point and X-rays of another energy are focused by the second half at the same point. If the X-ray source emits X-rays of variable energy, the X-rays received at a single focal point will be enhanced for two energies.

These and other advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings which are incorporated in and form a part of this specification, illustrate embodiments of the invention and, together with the description, serve to explain the principles of the invention.

The drawings referred to in this description should be understood as not being drawn to scale except if specifically noted.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
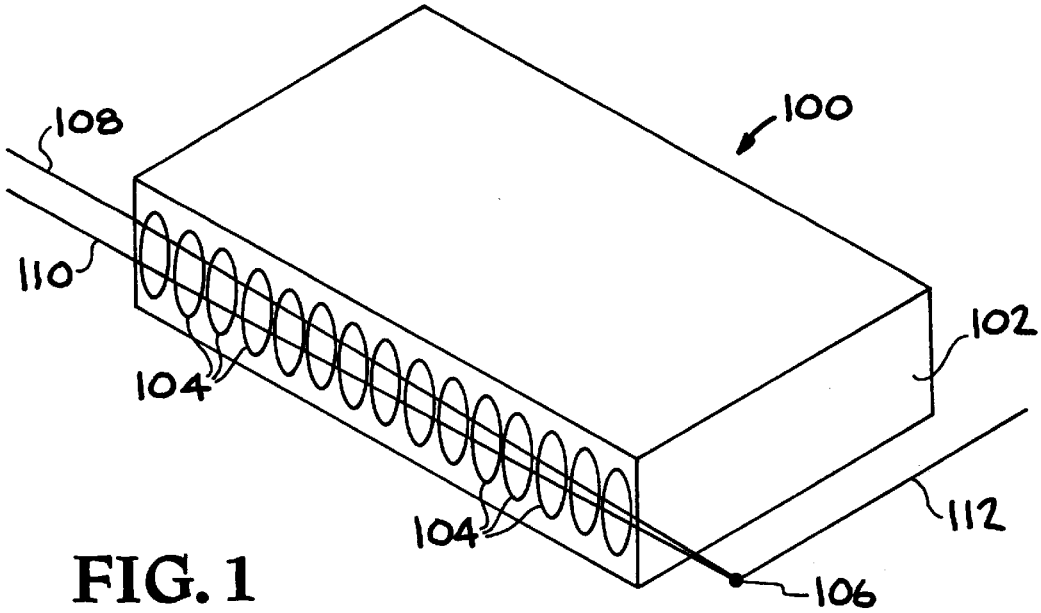
FIG. 1 is a perspective view of a commercial-grade compound refractive X-ray lens in accordance with one embodiment of the present invention.

With reference now to FIG. 1, a perspective view of a commercial-grade compound refractive X-ray lens 100 in accordance with one embodiment of the present invention is shown. Commercial-grade compound refractive X-ray lens 100 of the present embodiment is comprised of a volume of low-Z material. In the embodiment of FIG. 1, commercial-grade compound refractive X-ray lens 100 is formed of beryllium (Z-value of 4). Although such a low-Z material is used in this embodiment, the present invention is well suited to the use of various other low-Z materials such as, for example, plastics like polymethylmethacrylate (PMMA) (Z-value of approximately 6) etc.

Referring still to FIG. 1, commercial-grade compound refractive X-ray lens 100 has a first (e.g. top) surface, hidden, which is adapted to receive X-rays of commercially-applicable power emitted from a commercial-grade X-ray source, not shown. Thus, unlike the prior art, the present commercial-grade compound refractive X-ray lens 100 is not limited to focusing high energy X-rays generated, for example, by complex and experimental radiation sources such as the European Synchrotron Radiation Facility (ESRF). Commercial-grade compound refractive X-ray lens 100 also includes a second (e.g. bottom) surface 102 from which emerge the X-rays of commercially-applicable power which were received at the first surface.

As further shown in FIG. 1, commercial-grade compound refractive X-ray lens 100 has a plurality of openings, typically shown as 104, formed therein. The plurality of openings 104 are disposed between the first surface and second surface 102. Additionally, the plurality of openings 104 are oriented such that X-rays of commercially-applicable power, which are received at the first surface, pass through the volume of low-Z material and the plurality of openings 104, emerge from second surface 102, and are refracted to a focal point 106, which point depends on the energy of the X-rays. Although a focal point 106 is depicted in FIG. 1 for purposes of clarity, focal point 106 refers to the focal point of rays 108 and 110. However, during typical operation, all or a large portion of the first surface of commercial-grade compound refractive X-ray lens 100 will be impinged with X-rays. As a result, the impinging X-rays will be focused along a line 112 which includes focal point 106.

With reference still to FIG. 1, in the present embodiment, commercial-grade compound refractive X-ray lens 100 has a length of approximately 15 centimeters and a width of approximately from 1 to 50 centimeters. Further, commercial-grade compound refractive X-ray lens 100 of the present embodiment contains approximately 500 openings formed in the volume of low-Z material. Although such dimensions and opening parameters are recited in the present embodiment, the present invention is well suited to having various other dimensions and to having a greater or fewer number of openings.

As shown in the embodiment of FIG. 1, plurality of openings 104 are parabolic or "lenticular" in shape. That is, the plurality of openings 104 are shaped like a lens. In this embodiment, plurality of openings 104 are shaped similar to a convex lens. More specifically, plurality of openings 104 are each formed having a major axis of approximately 600 microns in length and a minor axis of approximately 300 microns in length. It will be understood that the present invention is well suited to embodiments having various other opening dimensions. By forming openings 104 having a narrow minor axis, and then orienting the openings such that the minor axis is substantially parallel to the direction of impinging X-rays, the present commercial-grade compound refractive X-ray lens 100 fits a greater number of openings with a given length. As a result, commercial-grade compound refractive X-ray lens 100 provides significantly greater refraction than is possible in prior art experimental high-energy X-ray focusing devices having circular-shaped openings. Consequently, unlike the meter-level focal lengths associated with prior art experimental high-energy X-ray focusing devices, the commercial-grade compound refractive X-ray lens 100 of the present embodiment attains a focal length on the order of decimeters. As a result, the commercial-grade compound refractive X-ray lens 100 of the present embodiment is better suited for commercial applications in which a focal length of the order of decimeters is desired.

Referring still to FIG. 1, focal length of compound refractive X-ray lens 100 is energy dependent. That is, different X-ray source. energies will have a different focal length. Thus, when the energy of the X-ray source is varied, the location of focal point 106 will also vary correspondingly. Beams peaked at different energy can be obtained by selecting different focal points. Additionally, in practice X-rays are detected with a small detector that has an aperture of finite dimensions. Its extent provides an aperture over which the device is sensitive. When the compound refractive X-ray lens 100 of the present invention is used in combination with a detector, X rays at or near the selected energy fall preferentially within the aperture, and X rays at higher or lower energies full preferentially outside the acceptance of the aperture.

As yet another advantage, the present invention reduces the power requirement on the X-ray source. That is, a lower power X-ray output can be focused to a higher intensity level using the present commercial-grade compound refractive X-ray lens 100. Therefore, instead of increasing the power requirement on the X-ray source, the present commercial-grade compound refractive X-ray lens 100 is used to achieve the desired output. Hence, X-ray images, for example, can be obtained with lower power consumption. Also, the lifespan of the X-ray sources in conjunction with the present invention are extended. That is, by reducing the power requirement of the X-ray source, the X-ray source is not subjected to the severe heating associated with conventional X-ray sources. By reducing the amount of heating, an X-ray source used in conjunction with the present invention is not "worn-out" as quickly as an X-ray source which is not used in conjunction with present invention.

Figure 2:
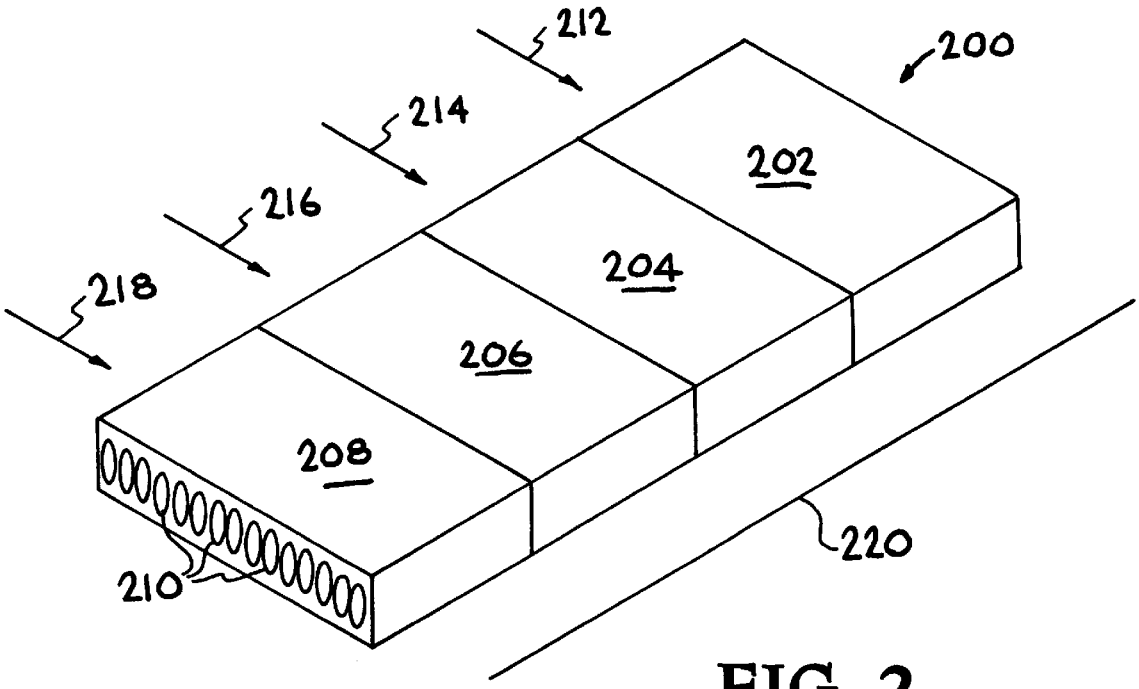
FIG. 2 is a perspective view of an array of commercial-grade compound refractive X-ray lenses in accordance with one embodiment of the present claimed invention.

Referring now to FIG. 2, an array 200 of commercial-grade compound refractive X-ray lenses is shown. In the embodiment of FIG. 2, array 200 is comprised of four commercial-grade compound refractive X-ray lenses 202, 204, 206, and 208. Openings, typically shown as 210, are formed into commercial-grade compound refractive X-ray lens 208. Although hidden from view, openings are also formed into commercial-grade compound refractive X-ray lenses 202, 204, and 206. In such an embodiment, X-rays oriented in the direction indicated by arrows 212, 214, 216, and 218 will impinge the respective first surfaces of commercial-grade compound refractive X-ray lenses 202, 204, 206, and 208. By forming array 200, the present embodiment provides a focal line 220 which is well suited for use as a scanning tool. That is, the present embodiment is well suited for use in, for example, medical imaging applications, non-destructive testing, imaging of items which are moved along a conveyor belt, and the like. The present invention is well suited for use with X-rays which have been oriented in the direction indicated by arrows 212, 214, 216, and 218 using, for example, a collimator in conjunction with one or more X-ray sources. As a result, the impinging X-rays will be focused along a line 220. Furthermore, although four commercial-grade compound refractive X-ray lenses 202, 204, 206, and 208 are shown in the present embodiment, the present invention is well suited to having a greater or fewer number of commercial-grade compound refractive X-ray lenses in array 200. Thus, the present invention is well suited to varying the length of focal line 220 by increasing or decreasing the number of commercial-grade compound refractive X-ray lenses used in the array.

Figure 3:
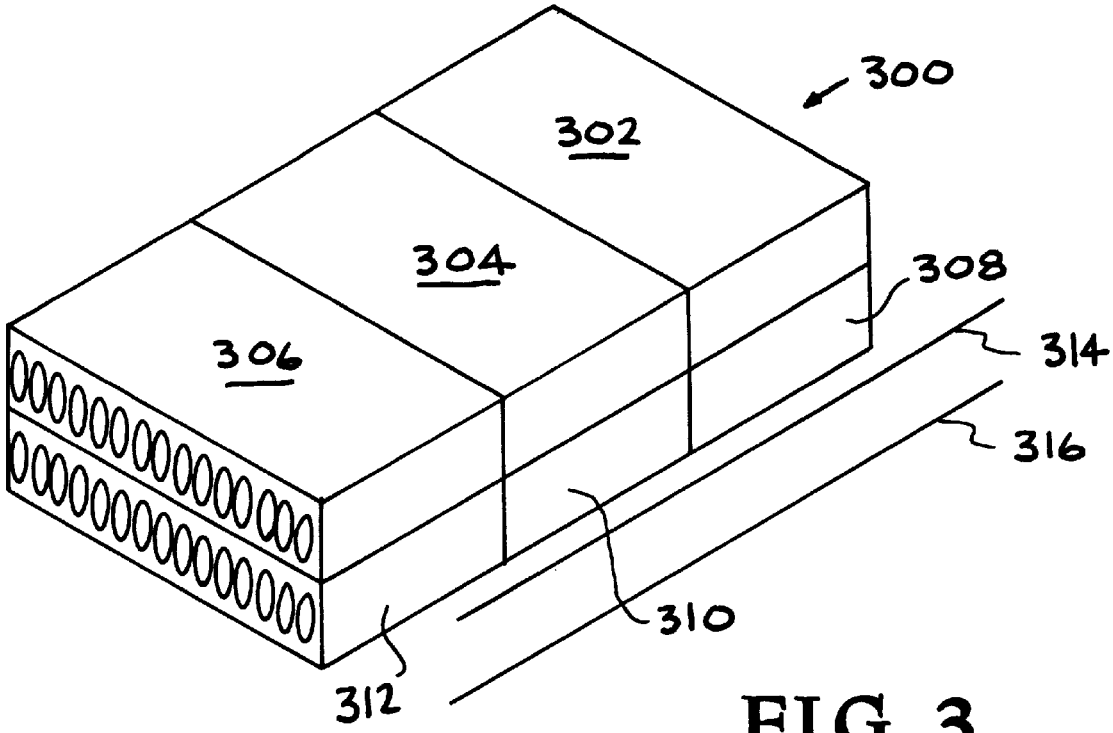
FIG. 3 is a perspective view of another array of commercial-grade compound refractive X-ray lenses in accordance with one embodiment of the present claimed invention.

Referring next to FIG. 3, a perspective view of another array 300 of commercial-grade compound refractive X-ray lenses 302, 304, 306, 308, 310, and 312 is shown. In such an embodiment, the present invention produces two parallel focal lines 314 and 316. Although specific arrays are shown in FIGS. 2 and 3, the present invention is well suited to forming an array having any of numerous possible orientations.

Figure 4A:
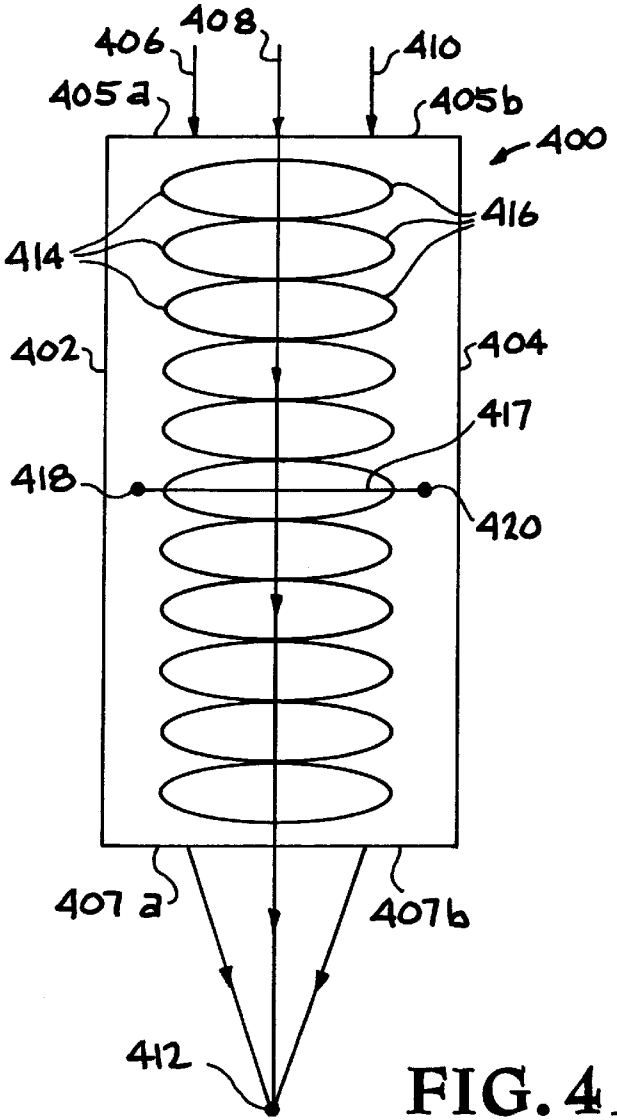
FIG. 4A is a side view of a split-compound refractive X-ray lens in accordance with one embodiment of the present claimed invention.

With reference next to FIG. 4A, a side view of a split-compound refractive X-ray lens 400 in accordance with one embodiment of the present invention is shown. As shown in FIG. 4A, split-compound refractive X-ray lens 400 is formed of two halves 402 and 404. Both halves 402 and 404 of split-compound refractive X-ray lens 400 of the present embodiment are comprised of a volume of low-Z material. In the embodiment of FIG. 4A, halves 402 and 404 of split-compound refractive X-ray lens 400 are formed of beryllium (Z-value of 4). Although such a low-Z material is used in this embodiment, the present invention is well suited to the use of various other low-Z materials such as, for example, plastics like polymethylmethacrylate (PMMA) (Z-value of approximately 6) etc. Additionally, each of halves 402 and 404 of split-compound refractive X-ray lens 400 has a first (top) surface, 405*a* and 405*b*, respectively, which receives X-rays. Halves 402 and 404 of split-compound refractive X-ray lens 400 also include a second (bottom) surface, 407*a* and 407*b*, which emits the X-rays received at the first surface.

In a single piece compound refractive X-ray lens, such as lens 100 of FIG. 1, refractive effects are minimal for X-rays passing through the mid-portion of the openings. For example, in a single piece compound refractive X-ray lens, X-rays impinging near the region represented by arrow 408 of FIG. 4A (i.e. near the center of the openings/indentations), pass through the lens, and their direction of travel is not significantly altered. However, X-rays impinging near the regions represented by arrows 406 and 410 (i.e. near the outer edges of the openings/indentations) are significantly refracted as they pass through the compound refractive X-ray lens.

Referring again to FIG. 4A, X-rays oriented as represented by arrows 406, 408, and 410 will intersect at focal point 412. More specifically, X-rays oriented as represented by arrow 408 will travel between halves 402 and 404 and will pass through focal point 412. X-rays oriented as represented by arrows 406 and 410 will pass through halves 402 and 404, will be refracted, and will pass through focal point 412. Thus, the present embodiment provides a compound refractive X-ray lens which is comprised of two separate halves.

With reference again to FIG. 4A, each of halves 402 and 404 has a plurality of indentations, typically shown as 414 and 416, respectively, formed therein. In the present embodiment, indentations 414 and 416 are "semi-lenticular" in shape. That is, the plurality of indentations 414 and 416 are shaped like one half of a lens. In this embodiment, plurality of indentations 414 and 416 are shaped similar to one half of a convex lens. The present invention is, however, well suited to having semi-circular shaped indentations, semi-oval shaped indentations, or various other shapes of indentations.

Figure 5:
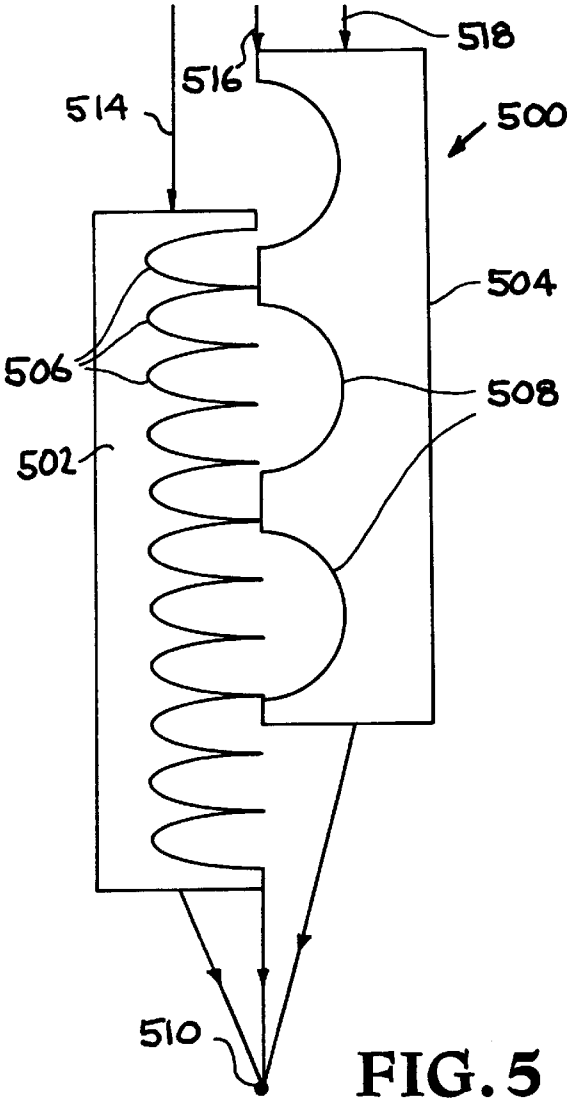
FIG. 5 is a side view of another embodiment of a split-compound refractive X-ray lens having differently shaped halves in accordance with one embodiment of the present claimed invention.

Referring now to FIG. 5, although indentations 414 and 416 are similarly shaped and sized, the present invention is well suited to an embodiment in which the indentations of the two halves are differently shaped. In the embodiment of FIG. 5, a split-compound refractive X-ray lens 500 is comprised of two halves 502 and 504. Half 502 has a plurality of indentations, typically shown as 506, formed in the side surface thereof. Half 504 also has a plurality of indentations, typically shown as 508, formed in the side surface thereof. In this embodiment, indentations 506 are shaped differently, and have a different size than the indentations 508 of half 504. As shown in FIG. 5, in the present embodiment, X-rays of one energy entering at point 514 and X-rays of another energy entering at point 518, will travel through halves 502 and 504 and converge at a single point 510. Thus, such an embodiment of the present invention provides a dual energy distribution from an X-ray source.

Additionally, although only a single split-compound refractive X-ray lens is shown in FIG. 4A and FIG. 5, the present invention is well suited to an embodiment in which split-compound refractive X-ray lenses are arranged in an array. Furthermore, it will be understood that X-rays (having any of various possible energies) directed as shown by arrow 516 will also pass through single focal point 510. Thus, the present invention is well suited to focusing X-rays of differing energies to a common focal point.

Referring again to FIG. 4A, in the present embodiment, halves 402 and 404 are mirror images of each other, and they are disposed such that the line 417 defined by the midpoint 418 of half 402 and the midpoint 420 of half 404 is oriented substantially orthogonal to the primary direction in which X-rays are emitted from an X-ray source (e.g. the direction indicated by arrows 406, 408, and 410). In the embodiment of FIG. 4A, a single focal point, and, therefore, a single energy distribution is obtained for a given X-ray source of a particular energy. As mentioned in conjunction with the embodiment of FIG. 1, different X-ray source energies will have different focal lengths. Thus, when the energy of the X-ray source is varied, the location of focal point 412 will also vary correspondingly.

Figure 4B:
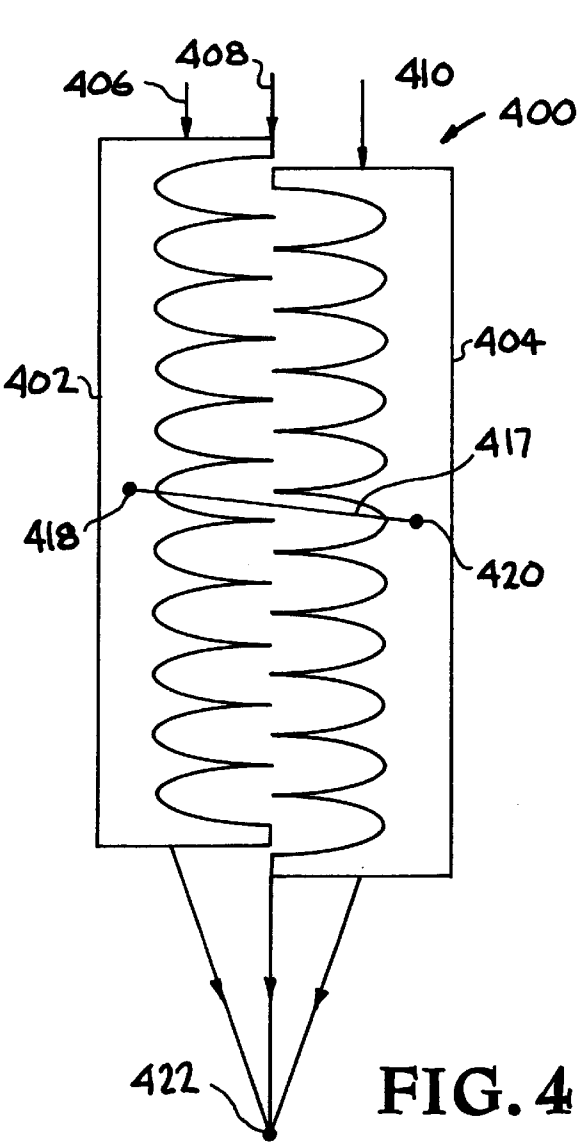
FIG. 4B is a side view of one embodiment of a split-compound refractive X-ray lens which has a shifted orientation in accordance with one embodiment of the present claimed invention.

With reference next to FIG. 4B, another embodiment of the present invention is shown in which halves 402 and 404 are shifted with respect to each other such that a dual energy distribution (e.g. two focal points 422 and 424) is achieved. In the embodiment of FIG. 4B, the distance between midpoint 418 of half 402 and midpoint 420 of half 404 is varied. More particularly, the position of halves 402 and 404 is shifted such that, unlike the embodiment of FIG. 4A, line 417 is not oriented orthogonal to the primary direction (e.g. the direction indicated by arrows 406, 408, and 410) in which X-rays are emitted from an X-ray source. As a result, X-rays of one energy entering at 406 and X-rays of another energy entering at 410 are focused at a single point, 422. Such dual energy distributions are beneficial in many applications including, for example, medical imaging and the like. Additionally, it will be understood that X-rays (having any of various possible energies) directed as shown by arrow 408 will also pass through point 422. Thus, the present invention is well suited to focusing X-rays of differing energies to a common focal point. The present invention is also well suited to varying the position of halves 402 and 404 such that incident X-rays are focused to separate focal points.

Figure 4C:
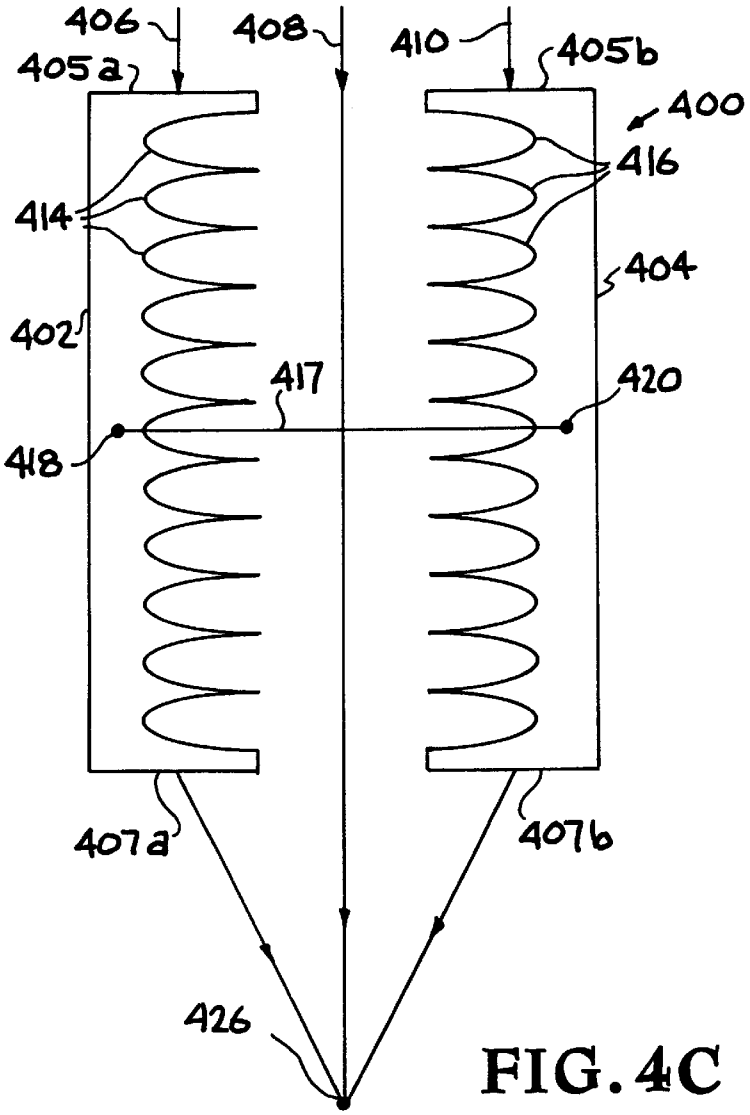
FIG. 4C is a side view of another embodiment of a split-compound refractive X-ray lens having a shifted orientation in accordance with one embodiment of the present claimed invention.

With reference now to FIG. 4C, another embodiment of the present invention is shown in which halves 402 and 404 are shifted with respect to each other such that the focal length of split-compound refractive X-ray lens is increased. That is, the focal point (e.g. focal point 426) is moved away from split-compound refractive X-ray lens 400. In the embodiment of FIG. 4C, the distance between midpoint 418 of half 402 and midpoint 420 of half 404 is varied. More particularly, the position of halves 402 and 404 is shifted such that the line 417 remains oriented orthogonal to the primary direction (e.g. the direction indicated by arrows 406, 408, and 410) in which X-rays are emitted from an X-ray source. As a result, the shifted split-compound refractive X-ray lens 400 of the present embodiment increases the effective focal length.

Figure 6A:
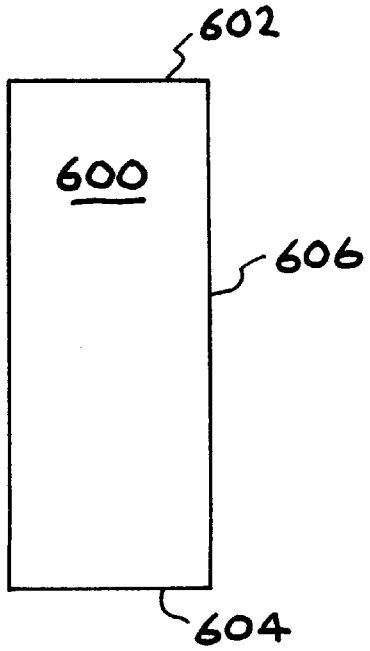
FIG. 6A is a side view of a volume of low-Z material used in the formation of one half of a split-compound refractive X-ray lens in accordance with the present claimed invention.

With reference now to FIG. 6A, the present split-compound refractive X-ray lens is advantageously manufactured. That is, instead of employing difficult and complex drilling procedures, the present split-compound refractive X-ray lens is formed in two separate halves. More specifically, this embodiment forms a volume 600 of low-Z material with a top surface 602, a bottom surface 604, and a side surface 606. In the embodiment of FIG. 6, volume 600 of low-Z material is formed of beryllium (Z-value of 4). Although such a low-Z material is used in this embodiment, the present invention is well suited to the use of various other low-Z materials such as, for example, plastics like polymethylmethacrylate (PMMA) (Z-value of approximately 6) etc. The dimensions of volume 600 are selected such that the resulting half of the split-compound refractive X-ray lens will be of a desired length and width.

Figure 6B:
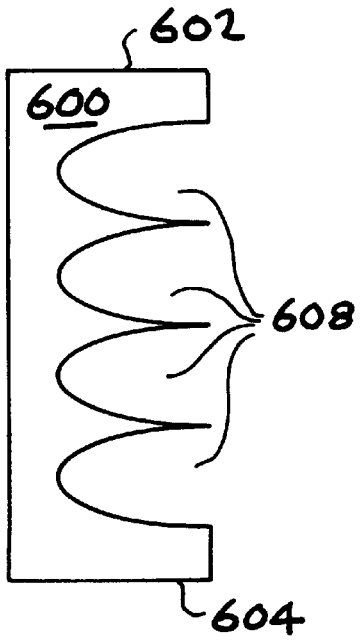
FIG. 6B is a side view of a completed half of a split-compound refractive X-ray lens formed in accordance with the present claimed invention.

Referring now to FIG. 6B, the present embodiment forms a plurality of indentations 608 in the side surface. In this embodiment, techniques such as, for example, diamond tooling, molding, hot pressing, electroplating, and the like are used to form plurality of indentations 608. Thus, the present embodiment provides a compound refractive X-ray lens half formation method which is not limited to the complex and difficult drilling steps associated with the prior art. Plurality of indentations 608 extend between top surface 602 and bottom surface 604. Furthermore, plurality of indentations 608 are located such that X-rays which are received at top surface 602, pass through volume of low-Z material 600 and through plurality of indentations 608, emerge from bottom surface 604, and are refracted to a focal point. Although openings 608 are lenticular in the embodiment of FIG. 6B, it will be understood that the present invention is well suited to forming indentations 608 having various other shapes and sizes. Hence, the present embodiment provides a method readily to form a compound refractive X-ray lens.

After the formation of the first half of the split-compound refractive X-ray lens, the method of the present embodiment can be used to form a second half of the split-compound refractive X-ray lens. Additionally, the present embodiment is well suited to forming the second half such that the second half is substantially identical to the first half. The present embodiment is also well suited to forming the second half such that the plurality of indentations in the second half are shaped differently than the plurality of indentations formed in the first half. The present embodiment is further well suited to forming the second half such that the resulting energy spectrum of the second half is different from that of the first half.

Thus, the present invention provides an X-ray lens which is well suited for commercial applications. The present invention further provides a method readily to form a compound refractive X-ray lens. The present invention also provides a compound refractive X-ray lens which is able to generate a dual energy distribution from a single X-ray source.

The foregoing descriptions of specific embodiments of the present invention have been presented for the purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby to enable others skilled in the art best to utilize the invention and various embodiments with various modifications as are suited to the particular use contemplated. It is intended that the scope of the invention be defined by the claims appended hereto and their equivalents.

What is claimed is:

1. A method for providing a dual energy distribution from an X-ray source using a split-compound refractive X-ray lens, said method comprising the steps of:

a) disposing a first half of a split-compound refractive X-ray lens proximate to an X-ray source, said first half having a first focal length and a midpoint disposed between a top surface and a bottom surface of said first half, said first half disposed such that a first portion of X-rays emitted from said X-ray source pass through said first half and are refracted to a first focal point; and b) disposing a second half of said split-compound refractive X-ray lens proximate to said X-ray source and said first half, said second half having a second focal length and a midpoint disposed between a top surface and a bottom surface of said second half, said second half disposed such that a second portion of said X-rays emitted from said X-ray source pass through said second half and are refracted to a second focal point.

2. The method for providing a dual energy distribution from an X-ray source as recited in claim 1 wherein said first focal point and said second focal point are coincident.

3. The method for providing a dual energy distribution from an X-ray source as recited in claim 1 wherein said first half and said second half are disposed such that a line defined by said midpoint of said first half and said midpoint of said second half is oriented substantially orthogonal to a primary direction in which said X-rays are emitted from said X-ray source.

4. The method for providing a dual energy distribution from an X-ray source as recited in claim 1 wherein said first focal length is different from said second focal length.

5. The method for providing a dual energy distribution from an X-ray source as recited in claim 3 further comprising the step of:

c) shifting the position of said second half with respect to said first half.

6. The method for providing a dual energy distribution from an X-ray source as recited in claim 5 wherein step c) comprises varying the distance between said midpoint of said first half and said midpoint of said second half position of said second half while keeping said line defined by said midpoint of said first half and said midpoint of said second half oriented substantially orthogonal to said primary direction in which said X-rays are emitted from said X-ray source.

7. The method for providing dual energy distribution from an X-ray source as recited in claim 5 wherein step c) comprises varying the distance between said midpoint of said first half and said midpoint of said second half position of said second half and varying the orientation of said line defined by said midpoint of said first half and said midpoint of said second half such that said line is not oriented orthogonal to said primary direction in which said X-rays are emitted from said X-ray source.

8. A split-compound refractive X-ray lens comprising: A first half of a split-compound refractive X-ray lens, said first half further comprising: a volume of low-Z material, said volume of low-Z material having a top surface that receives X-rays emitted from an X-ray source, said volume of low-Z material having a bottom surface from which emerge said X-rays received at said top surface, and a side surface extending between said top surface and said bottom surface from which emerge said X-rays received at said top surface, and a first plurality of indentations formed in said side surface, said plurality of indentations disposed between said top surface and said bottom surface, said plurality of indentations oriented such that said X-rays which are received at said top surface, pass through said volume of low-Z material and said plurality of indentations, and emerge from said bottom surface are refracted to a first focal point; and a second half of said split-compound refractive X-ray lens, said second half further comprising:

a volume of low-Z material, said volume of low-Z material having a top surface adapted to receive X-rays emitted from an X-ray source, said volume of low-Z material having a bottom surface adapted to emit said X-rays received at said top surface, and a side surface extending between said top surface and said bottom surface; and a second plurality of indentations formed in said side surface, said plurality of indentations disposed between said top surface and said bottom surface, said plurality of indentations oriented such that said X-rays which are received at said top surface, pass through said volume of low-Z material and said plurality of indentations, and emerge from said bottom surface are refracted to a second focal point, said first and second focal points being the same point, the shape of said first plurality of indentations being sufficiently different from the shape of said second plurality of indentations, so as to create separate and distinct energy levels for x-rays passing through said first half of the split-compound refractive x-ray lens, and for x-rays passing through said second half of said split-compound refractive x-ray lens.

9. The split-compound refractive x-ray lens of claim 8 wherein said volume of low-Z material of said first half is comprised of a plastic material.

10. The split-compound refractive X-ray lens of claim 9 wherein said plastic material is comprised of polymethylmethacrylate.

11. The split-compound refractive X-ray lens of claim 8 wherein said volume of low-Z material of said first half is comprised of beryllium.

12. The split-compound refractive X-ray lens of claim 8 wherein said volume of low-z material of said second half is comprised of a plastic material.

13. The split-compound refractive X-ray lens of claim 12 wherein said plastic material is comprised of polymethylmethacrylate.

14. The split-compound refractive X-ray lens of claim 8 wherein said volume of low-Z material of said second half is comprised of beryllium.

15. The split-compound refractive X-ray lens of claim 8 wherein said plurality of indentations in said side surface of said second half have a lenticular shape.

16. The split-compound refractive X-ray lens of claim 8 wherein at least one of said plurality of indentations in said side surface of said first half and said plurality of indentations in said side surface of said second half have a lenticular shape.

17. The split-compound refractive X-ray lens of claim 8 wherein said split-compound refractive X-ray lens is coupled to at least one compound refractive X-ray lens such that an array of compound refractive X-ray lenses is formed.

18. A method for forming a split-compound refractive X-ray lens, said method comprising the steps of:

a) forming a first half of a split-compound refractive X-ray lens, said first half of said split-compound refractive X-ray lens having a first focal length, said method for forming said first half further comprising the steps of:

a1) forming a volume of low-Z material with a top surface and a bottom surface, said top surface adapted to receive X-rays emitted from an X-ray source, said bottom surface adapted to emit said X-rays received at said top surface; and a2) forming a plurality of indentations in a side surface extending between said top surface and said bottom surface, said plurality of indentations being formed such that said X-rays which are received at said top surface, pass through said volume of low-Z material and said plurality of indentations, are emitted from said bottom surface, and are refracted to a first focal point, and b) forming a second half of a split-compound refractive X-ray lens, said second half of said split-compound refractive X-ray lens having a second focal length, said method for forming said second half further comprising the steps of:

b1) forming a volume of low-Z material with a top surface and a bottom surface, said top surface adapted to receive X-rays emitted from an X-ray source, said bottom surface being adapted to emit said X-rays received at said top surface; and b2) forming a plurality of indentations in a side surface extending between said top surface and said bottom surface, said plurality of indentations formed such that said X-rays which are received at said top surface, pass through said volume of low-Z material and said plurality of indentations, are emitted from said bottom surface and are refracted to a second focal point, said first and second focal points being the same point the shape of said first plurality of indentations being sufficiently different from the shape of said second plurality of indentations, so as to create separate and distinct energy levels 1) for x-rays passing through said first half of the split-compound refractive x-rays lens, and 2) for x-rays passing through said second half of said split-compound refractive x-ray lens.

19. The method for forming a split-compound refractive X-rays lens as recited in claim 18 wherein steps a1 and b1) comprise forming said volume of low-Z material from plastic.

20. The method for forming a split-compound refractive X-rays lens as recited in claim 18 wherein steps a1 and b1) comprise forming said volume of low-Z material from polymethylmethacrylate.

21. The method for forming a split-compound refractive X-rays lens as recited in claim 18 wherein steps a1 and b1) comprise forming said volume of low-Z material from beryllium.

22. The method for forming a portion of a split-compound refractive X-rays lens as recited in claim 18 wherein step a2) comprises forming a plurality of lenticular shaped indentations in said side surface of said first half.

23. The method for forming a split-compound refractive X-rays lens as recited in claim 18 wherein step b2) comprises forming a plurality of lenticular shaped indentations in said side surface of said second half.

24. The method for providing a dual energy distribution from an X-ray source as recited in claim 1 by impinging said split-compound refractive X-ray lens with X-rays of more than one energy.

* * * * *